US005857343A

United States Patent [19]

Cho et al.

[11] Patent Number: 5,857,343

[45] Date of Patent: Jan. 12, 1999

[54] ROOM AIR CONDITIONER HAVING INLET AND OUTLET CLOSURES AND METHODS FOR THEIR OPERATION

[75] Inventors: Jae-Seok Cho, Seoul; Gab-Youl Lee, Suwon; Young-Man Kim, Seoul; Youn-Woong Bang, Sungnam, all of Rep. of Korea

[73] Assignee: Samsung Electronics Co., Ltd., Suwon, Rep. of Korea

[21] Appl. No.: 916,453

[22] Filed: Aug. 22, 1997

[30] Foreign Application Priority Data

| | | | |
|---|---|---|---|
| Aug. 22, 1996 | [KR] | Rep. of Korea | 1996 34868 |
| Aug. 22, 1996 | [KR] | Rep. of Korea | 1996 34869 |
| Aug. 22, 1996 | [KR] | Rep. of Korea | 1996 34870 |
| Aug. 22, 1996 | [KR] | Rep. of Korea | 1996 34871 |
| Aug. 22, 1996 | [KR] | Rep. of Korea | 1996 34872 |
| Aug. 22, 1996 | [KR] | Rep. of Korea | 1996 34873 |
| Aug. 22, 1996 | [KR] | Rep. of Korea | 1996 34874 |
| Aug. 28, 1996 | [KR] | Rep. of Korea | 1996 36084 |

[51] Int. Cl.[6] ..... F25B 49/00

[52] U.S. Cl. ..... 62/89; 62/131; 62/180; 454/236; 454/256

[58] Field of Search ..... 62/89, 131, 180, 62/186, 408, 409, 262; 318/264, 265, 266, 267, 282, 286, 468; 454/236, 239, 296, 324; 236/49.3; 340/524, 686

[56] References Cited

U.S. PATENT DOCUMENTS

| | | | |
|---|---|---|---|
| 4,848,214 | 7/1989 | Nagao et al. | 454/236 |
| 5,443,420 | 8/1995 | Kim et al. | 454/256 |
| 5,461,875 | 10/1995 | Lee et al. | 62/180 X |

*Primary Examiner*—Harry B. Tanner
*Attorney, Agent, or Firm*—Burns, Doane, Swecker & Mathis, L.L.P.

[57] ABSTRACT

A room air conditioner includes an air inlet, an air outlet, a heat exchanger disposed between the inlet and outlet, and an air circulation fan. The inlet is opened and closed by motor-driven inlet vanes. The outlet is opened and closed by a vertically slidable motor-driven door. Air direction control vanes extend across the outlet for varying the direction of discharged air. Before the door is either opened or closed, the air control vanes are automatically swung upwardly to a clearance position to avoid interfering with movement of the door. When the inlet and outlet are to be closed, the inlet vane motor is actuated prior the door motor to ensure that the inlet and outlet are fully closed simultaneously, even though it takes longer for the inlet vanes to travel to their fully closed state. A sensor determines when the door reaches an almost-closed state, and the door motor continues to operate for a set period thereafter to ensure that the door becomes fully closed.

22 Claims, 12 Drawing Sheets

ROOM AIR CONDITIONER HAVING INLET AND OUTLET CLOSURES AND METHODS FOR THEIR OPERATION

BACKGROUND OF THE INVENTION

1. Field of the Invention

The present invention relates to an air conditioner and methods of its operation.

2. Description of the Prior Art

An air conditioner according to the prior art includes, as illustrated in FIGS. 1 and 2, a suction grille member 5 formed with a plurality of suction inlets 3 for sucking in room air and disposed at a lower portion of an indoor unit body 1 (hereinafter referred to as a body), and a discharge outlet 7 formed at an upper front surface of the body 1 for discharging indoors the air which is heated or cooled while passing through the air conditioner.

The discharge outlet 7 is provided with horizontal vanes 9 swingable about horizontal axes for vertically adjusting the direction of the air discharged indoors therethrough and vertical vanes 11 rotatable about vertical axes for horizontally adjusting the direction of the air.

The air conditioner is provided with a discharge outlet door 13 for preventing foreign objects from entering therethrough and for forming an external appearance thereof.

The body 1 includes a cover member 15 for forming an external appearance thereof and for protecting the various elements therein.

The cover member 15 is provided with a manipulating unit 17 for adjusting the amount and direction of the air discharged through the discharge outlet 7, selecting the operating modes (automatic, cooling, heating, dehumidifying, blow and the like) and to start/stop the operation.

As illustrated in FIG. 3, driving means for horizontally moving the discharge outlet door 13 is formed by a support member 19 fixed to an upper front area of the body 1, a discharge outlet motor 21 fixed to the support member 19 to generate a power for vertically moving the discharge outlet door 13, a pinion 23 coupled to an axis 22 of the discharge outlet motor 21, and a rack for changing a rotary movement of the pinion 23 to a rectilinear movement.

Furthermore, driving means for moving the horizontal vanes 9 includes a louver motor 27 (by way of example, a stepping motor) disposed in the body 1 and a plurality of link members 29 for being cooperatively driven by the louver motor 27 to thereby rotate a plurality of horizontal vanes 9.

In the air conditioner thus constructed, when a user selects an operation mode according to the manipulation of a remotely controlled unit or an operating unit 17 to thereby activate an operation/stop key (hereinafter referred to as operation key), the discharge outlet motor 21 is driven in a forward direction to rotate the rack 25 downward, so that the discharge outlet door 13 coupled to the rack 25 is moved downward to thereby open the discharge outlet 7.

At this time, when it is determined by door open/close sensors attached at predetermined upper and lower positions of the discharge outlet 7 that the discharge outlet 7 is completely opened, the discharge outlet motor 21 is stopped, and an indoor fan (not shown) is rotated to cause the room air to be sucked into the body 1 through the suction inlet 3.

The room air sucked through the suction inlet 3 passes through a heat exchanger (not shown) to thereafter be heat-exchanged by latent heat of refrigerant flowing in the heat exchanger.

The heat-exchanged air is guided upward to thereafter be discharged indoors via the discharge outlet 7, which is then adjusted in its direction vertically or horizontally according to angles of the horizontal vanes 9 and vertical vanes 11 to perform an air conditioning in the room.

At this time, when an operation key associated with the horizontal vanes 9 is turned on at the operating unit 17, the louver motor 27 is rendered operative and a plurality of link members are cooperatively driven to vertically swing the horizontal vanes 9.

When the key is turned on again, the louver motor 27 is rendered inoperative and the horizontal vanes 9 is are stopped to thereby establish a vertical component of the direction of the air flow.

When the operating key is turned off under a normal operation of the air conditioner thus described, the discharge outlet motor 21 is driven in reverse, and the pinion 23 is driven to shift the rack 25 upward, so that the discharge outlet door 13 is moved upward to close the discharge outlet 7.

When it is determined by the door open/close sensors that the discharge outlet 7 is completely closed, the discharge outlet motor 21 is stopped and the air conditioner enters a stand-by state until the operation key is turned on again.

However, there is a problem in the conventional air conditioner thus constructed, in that the suction inlet 3 is open at all times even when the air conditioner is not operated, to enable dust, foreign objects and the like to be induced into the body 1 and to accumulate on surfaces of the heat exchanger and to thereby decrease the performance thereof.

There is another problem in that the vertical vanes 9 are randomly positioned when the air conditioner is turned off to thereby cause an unsatisfactory open/close operation of the discharge outlet door 13 due to contact between the door and the horizontal vanes 9 possibly resulting in a destruction of elements or an erroneous operation thereof.

There is still another problem in that upward travel extent of the discharge outlet door 13 may be limited due to a deformation of parts when a heavy load or the like is placed on an upper area of the body 1 to thereby press the upper area thereof downwardly. As a result, the discharge outlet door 13 may not be pushed far enough to enable the door open/close sensors to detect open/close operations of the discharge outlet door 13, thereby resulting in an error.

SUMMARY OF THE INVENTION

The present invention is disclosed to solve the aforementioned problems and it is an object of the present invention to provide an open/close control apparatus of an air conditioner and a method thereof by which the suction inlet and a discharge outlet reach their fully open states simultaneously to thereby perform a pleasing operation of the air conditioner.

It is another object of the present invention to provide an open/close control apparatus of an air conditioner and a method thereof by which vanes are swung upward (e.g., by 10 degrees) when the discharge outlet is to be opened (lowered) to thereby enable a smooth opening operation of the discharge outlet door to take place.

It is still another object of the present invention to provide an open/close control apparatus of an air conditioner and a method thereof by which vanes are swung upward (e.g., by 80 degrees) when the discharge outlet is to be closed to thereby enable a smooth closing operation of the discharge outlet door to take place.

It is a further object of the present invention to provide an open/close control apparatus of an air conditioner and a method thereof by which a closing apparatus of the discharge outlet is placed in a completely closed position to thereby close the discharge outlet door accurately even when there occurs a mechanical problem at an upper end thereof.

It is still a further object of the present invention to provide an open/close control apparatus of an air conditioner and a method thereof by which vanes are positioned at a center, horizontal position when the discharge outlet is completely opened to effectively direct the flow of discharged air.

These and other objects are achieved by the present invention which relates to a method of operating a room air conditioner which includes a housing forming an air inlet for receiving incoming room, and an outlet for discharging the air back into the room. Vanes extend across the outlet and are mounted for swinging movement to adjust a flow direction of discharged air. A motor-actuated vane drive arrangement is provided for swinging the outlet vanes. A heat exchanger is disposed between the air inlet and air outlet for changing the temperature of air passing therethrough. An air circulator (e.g. a fan) is provided for circulating air into the inlet, through the heat exchanger, and out through the outlet. Inlet and outlet closures are provided for closing the inlet and outlet, respectively. A motor-driven first mechanism is provided for moving the inlet closure between and open and closed states. A motor-driven second mechanism is provided for moving the outlet closure between open and closed states. An input mechanism is provided for inputting operation instructions, including operation start and stop instructions. The method comprises the steps of:

A. actuating the vane drive arrangement for moving the outlet vanes to a clearance position facilitating an opening of the outlet closure in response to an operation start instruction being input to the input mechanism; thereafter B. actuating the first and second mechanisms for opening the inlet and outlet closures respectively; thereafter C. swinging the vanes to a position for discharging air in a generally forward horizontal direction; and thereafter D. actuating the circulator and heat exchanger for performing an air conditioning operation.

It is also preferable to provide the following steps:

E. actuating the vane drive arrangement for moving the vanes to a clearance position facilitating closing of the outlet closure, in response to an operation stop instruction being input to the input mechanism; and thereafter F. actuating the first and second mechanisms for closing the inlet and outlet closures, respectively.

Another aspect of the invention involves the use of a detector for sensing a position of the outlet closure at a time before the outlet closure reaches a fully closed state during a closing operation. The closing step would be continued for a predetermined time period following the detection of the outlet closure, to ensure that the outlet closure becomes fully closed.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
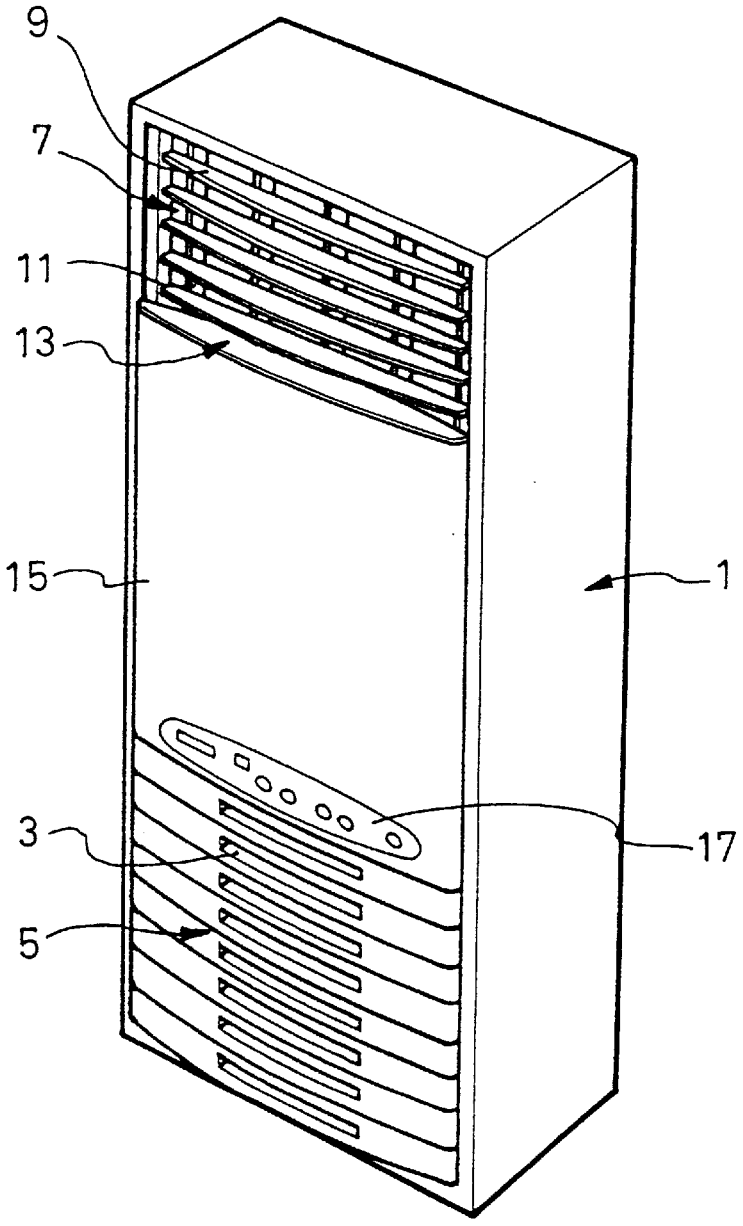
FIG.1 (PRIOR ART)
FIG. 1 is a perspective view of a conventional air conditioner when a discharge outlet is open.
Figure 2:
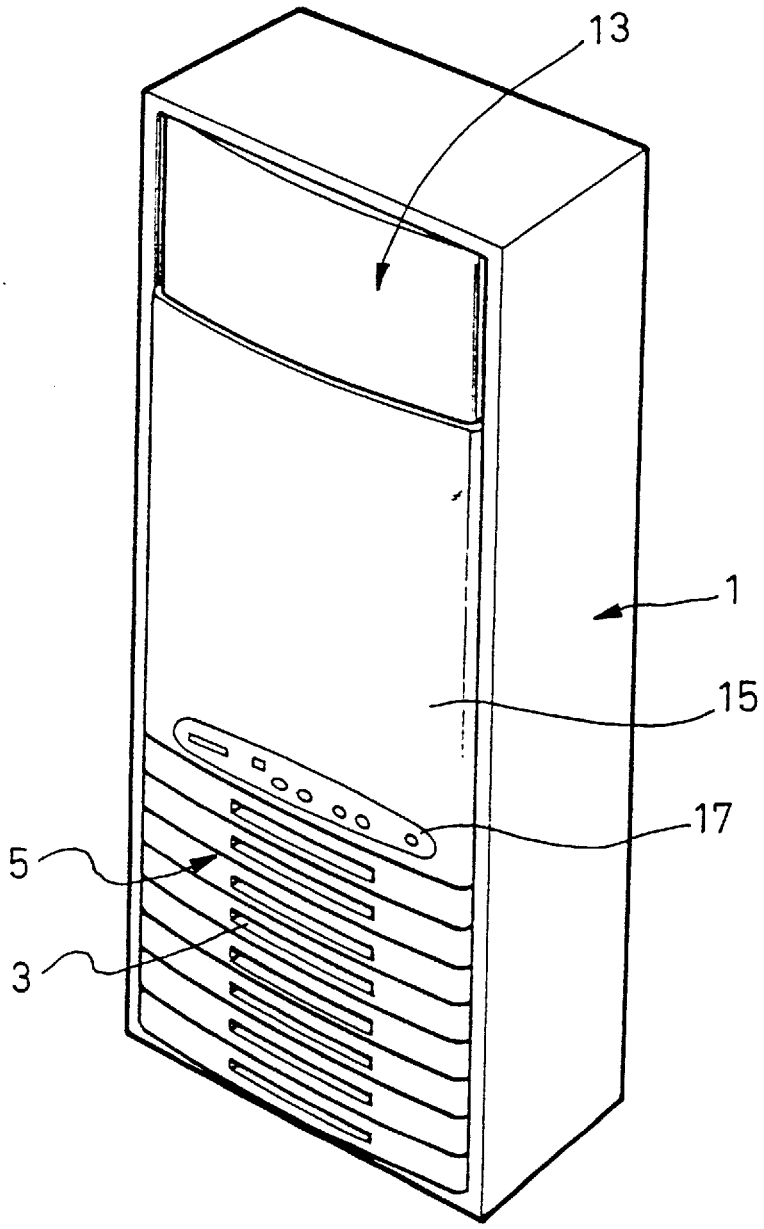
FIG.2 (PRIOR ART)
FIG. 2 is a perspective view of the conventional air conditioner when the discharge outlet is closed.
Figure 3:
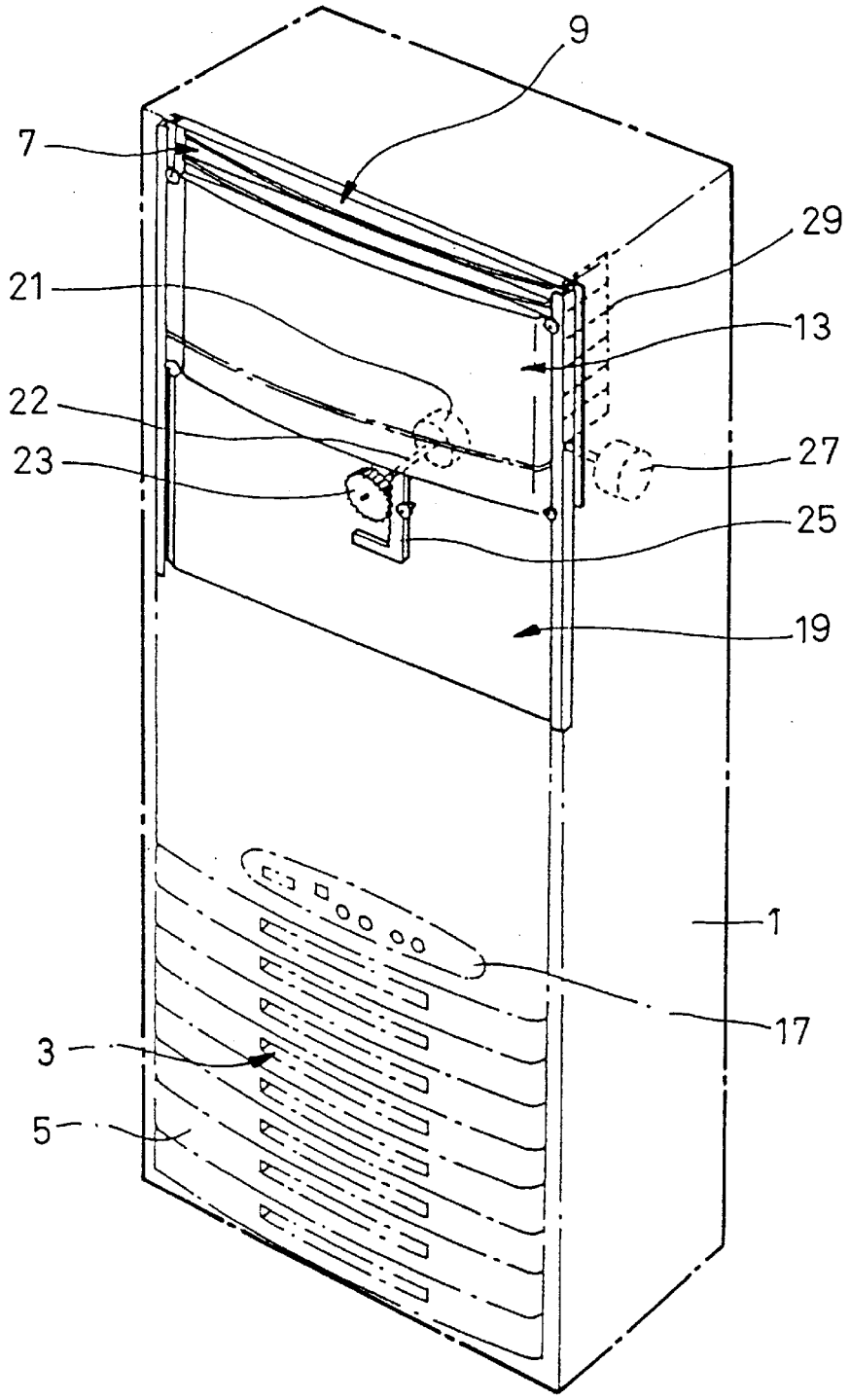
FIG.3 (PRIOR ART)
FIG. 3 is a schematic block diagram for illustrating a construction of the conventional air conditioner.

Throughout the drawings, like reference numerals and symbols as in FIGS. 1 to 3 are used for designation of like or equivalent parts or portions for simplicity of illustration and explanation, and redundant references will be omitted.

Figure 4:
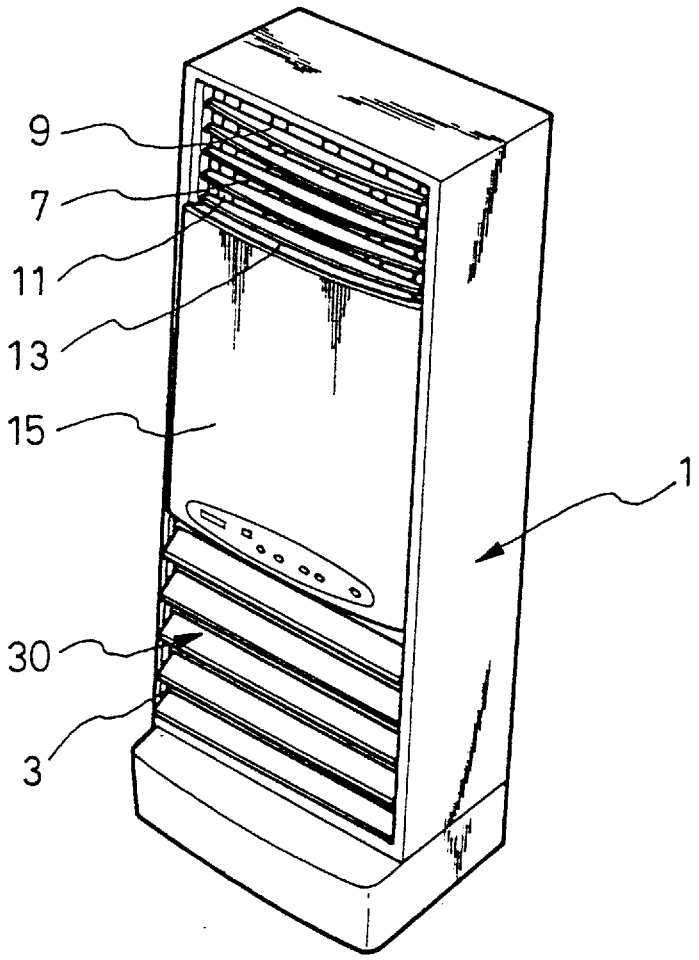
FIG. 4 is a perspective view for illustrating an air conditioner according to the present invention with the discharge outlet open.

As illustrated in FIG. 4, the suction inlet 3 formed at a lower portion of the body 1 is provided with suction inlet closure 30 for opening the suction inlet 3 when the air conditioner is operative and for closing the inlet 3 to prevent the infusion of dust, foreign objects and the like when the air conditioner is not operative, and to form a pleasing external appearance of the air conditioner. A closure 13 in the form of a door is vertically movable to open and close the outlet 7.

Figure 5:
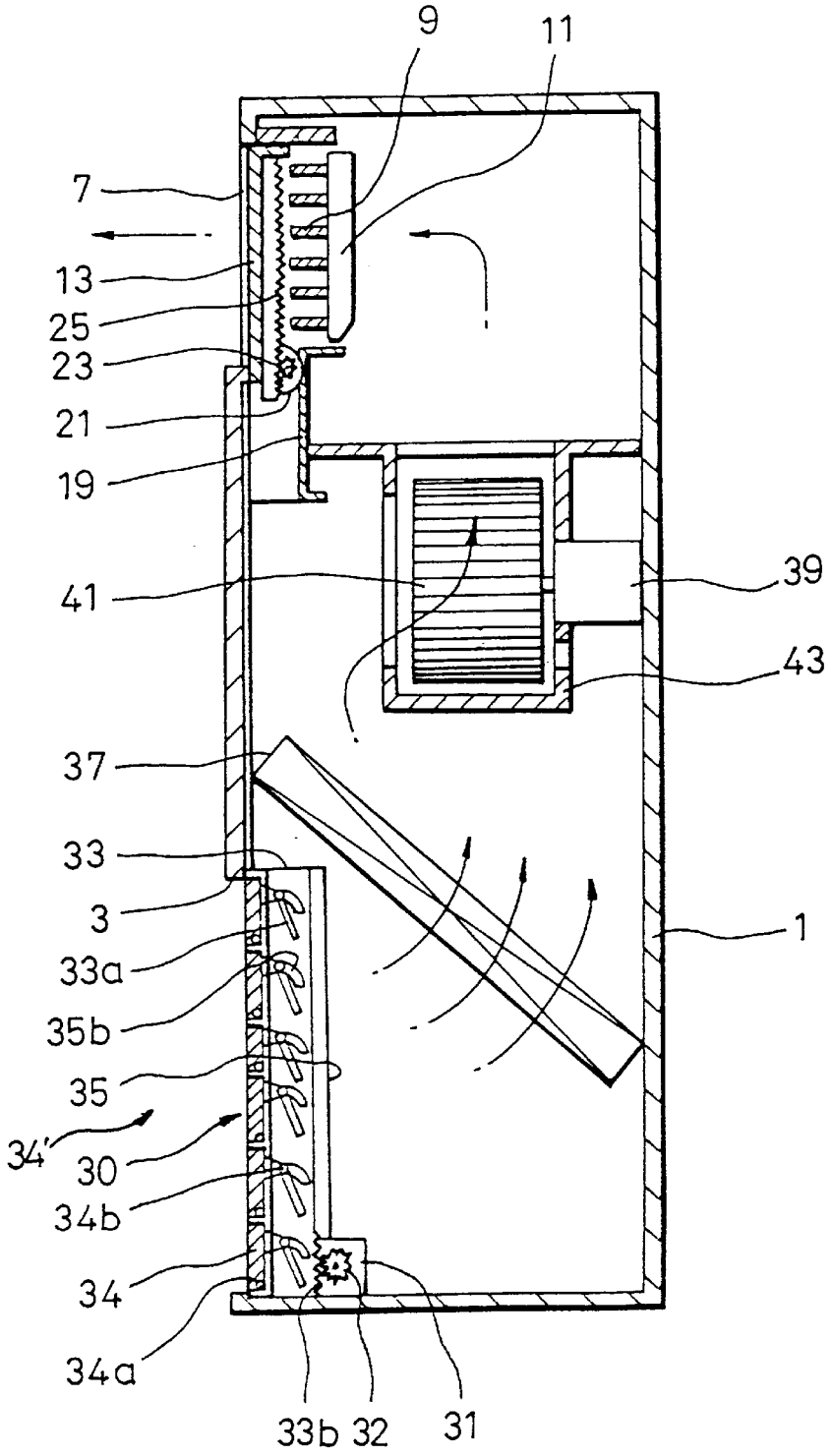
FIG. 5 is a longitudinal sectional view for illustrating the air conditioner according to the present invention when a discharge outlet and a suction inlet are closed.

As illustrated in FIG. 5, the suction inlet closure 30 includes a pinion 32 for receiving an electric power of a suction inlet motor 31 to be rotated in forward and reverse directions, a slide member 33 engaging one side of the pinion 32 to be vertically moved in a linear direction according to the forward/reverse rotation of the pinion 32, a suction grille 34' formed by plurality of vanes 34 rotated by the linear movement of the slide member 33 to open and close the suction inlet 3, and guide members 35 disposed at both sides of the vanes 34 to enable the vanes 34 to be rotatatively supported and guided.

The suction inlet closure 30 is disposed upstream of a bar-shaped heat exchanger 37, and a fan 41 (hereinafter referred to as an indoor fan) is disposed above the heat exchanger 37.

The indoor fan 41 is encased within a duct member 43 which covers the fan 41 and for guiding the flow of the air toward the discharge outlet 7.

Figure 6:
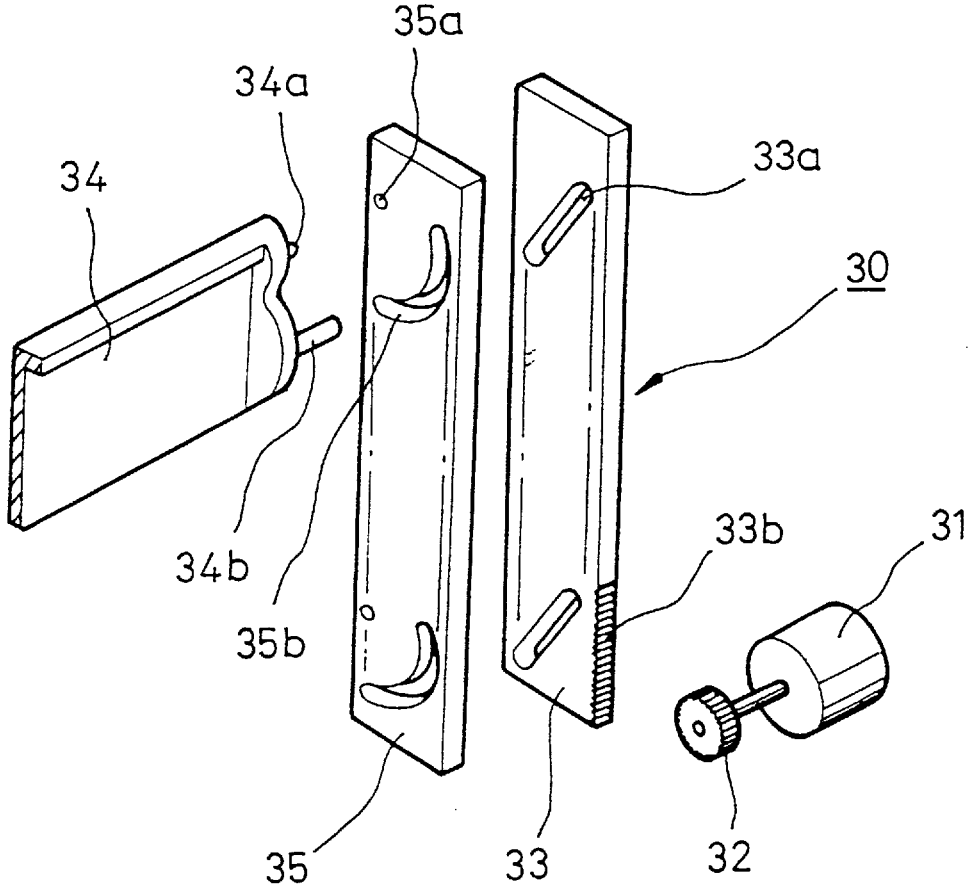
FIG. 6 is a perspective exploded view for illustrating principal elements according to the present invention.

As illustrated in FIG. 6, each end of each of the vanes 34 is provided with a hinge axle 34*a* for rotatatively supporting the vanes, and one end of each vane 34 is provided with a protruder 34*b* extending into a slot disposed in the slide member 33.

Each of the guide member 35 is formed with fixed holes 35*a* in which respective hinge axles 34*a* are rotatably disposed.

One of the guide members 35 is formed with arch-shaped guide grooves 35*b* through which respective ones of the protruders 34*b* extend. The grooves are suitably oriented to open the vanes 34 when the slide member 33 is raised, and to close the vanes 34 when the side member 33 is lowered.

The slide member 33 is provided along one edge thereof with gear teeth 33*b* meshed with the pinion 32.

Now, a circuit block diagram for controlling the open/close operation of the suction grille 34' and the discharge outlet 13 in the air conditioner thus constructed will be described with reference to FIGS. 7, 8 and 8A.

Figure 7:
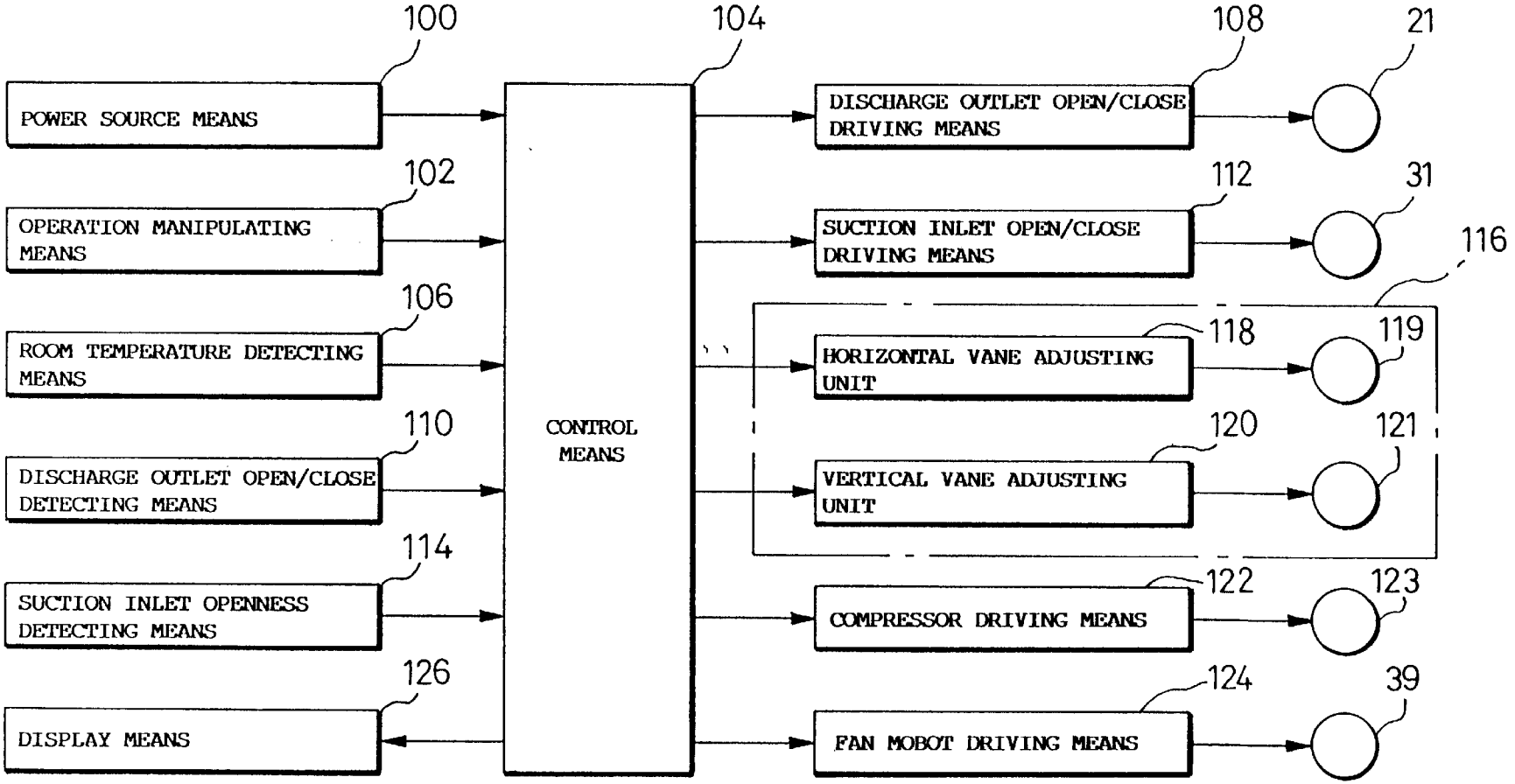
FIG. 7 is a control block diagram of an open/close control apparatus of an air conditioner according to the present invention.
Figure 8:
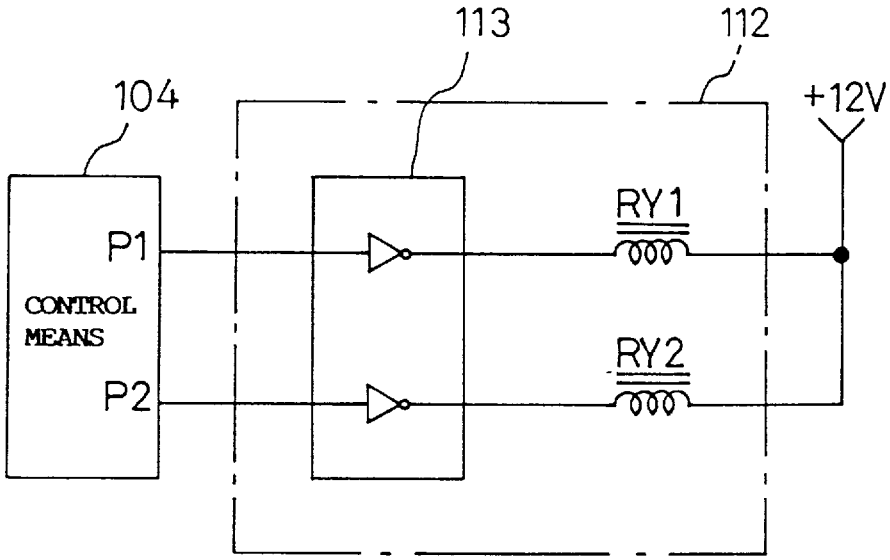
FIG. 8 is a detailed circuit diagram of suction inlet open/close driving means according to the present invention.
Figure 8A:
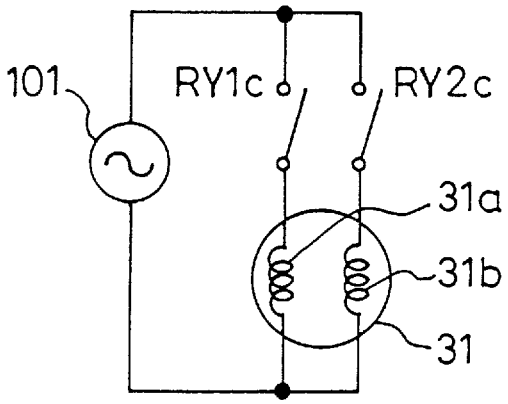
FIG. 8A is a circuit diagram of a section of a controller depicted in FIG. 8, for actuating an inlet vane actuating motor.
Figure 9A:
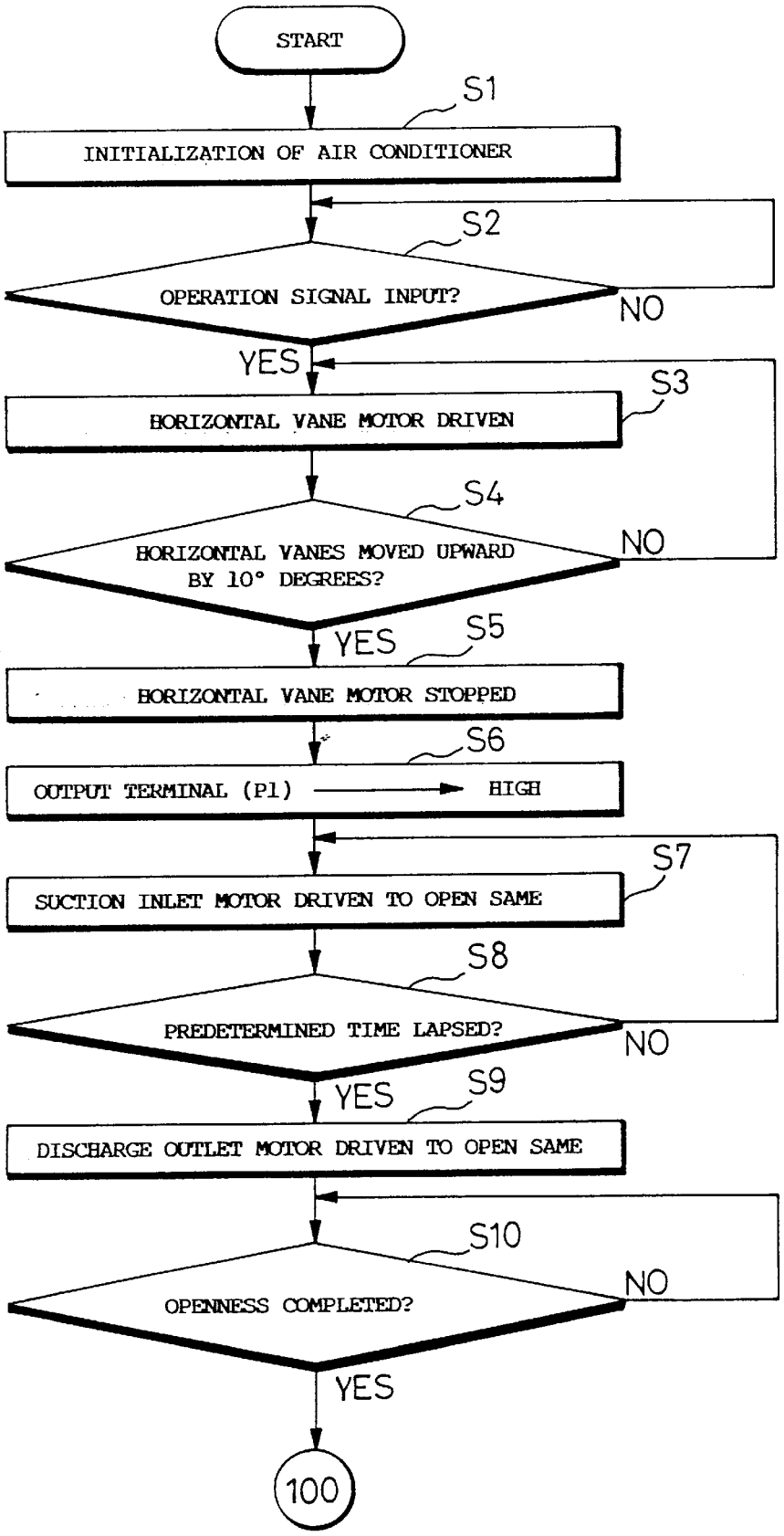
FIGS. 9A through 9D are flow charts for illustrating an open/close control operational process of an air conditioner according to the present invention.
Figure 9B:
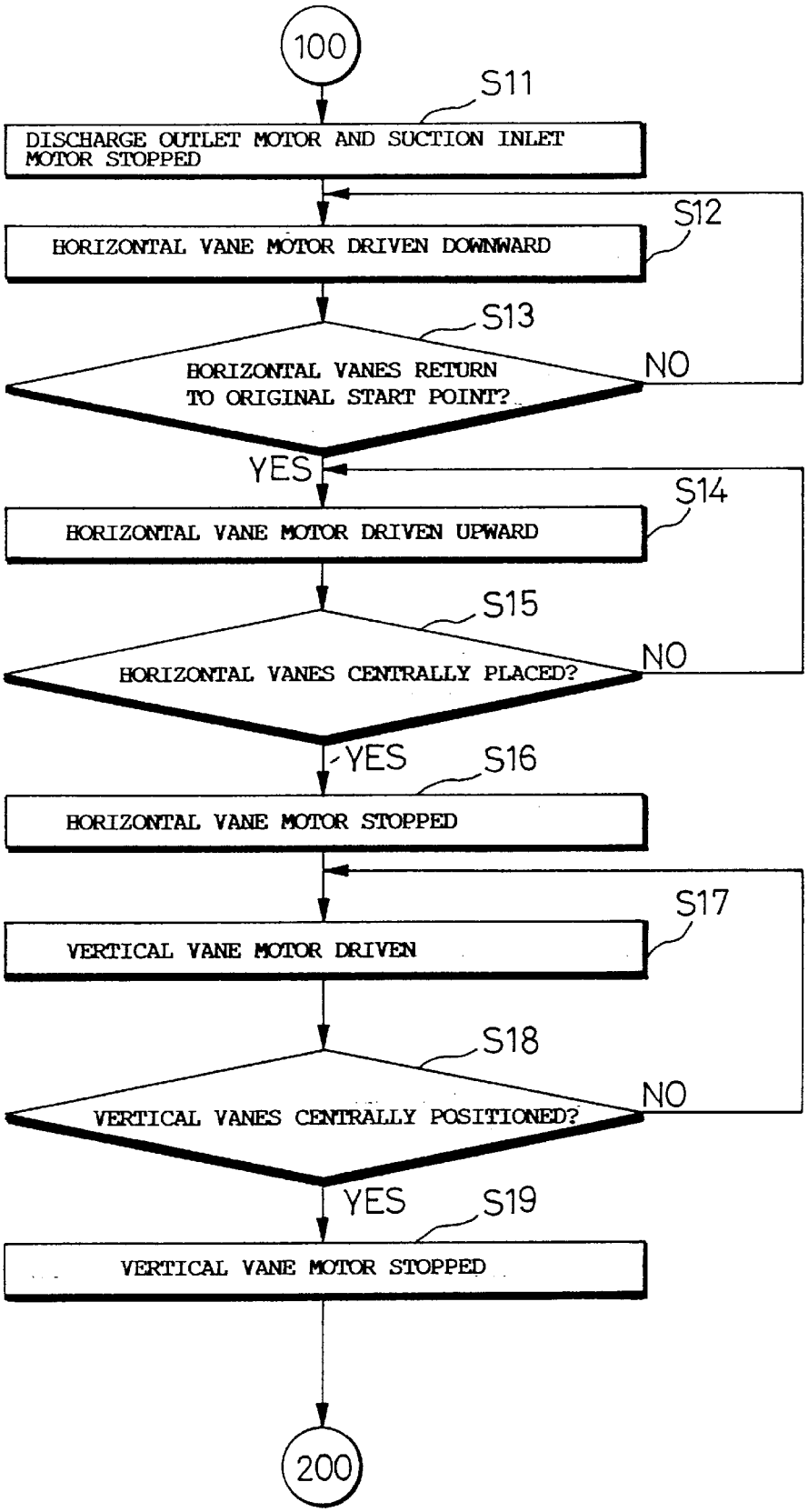
Figure 9C:
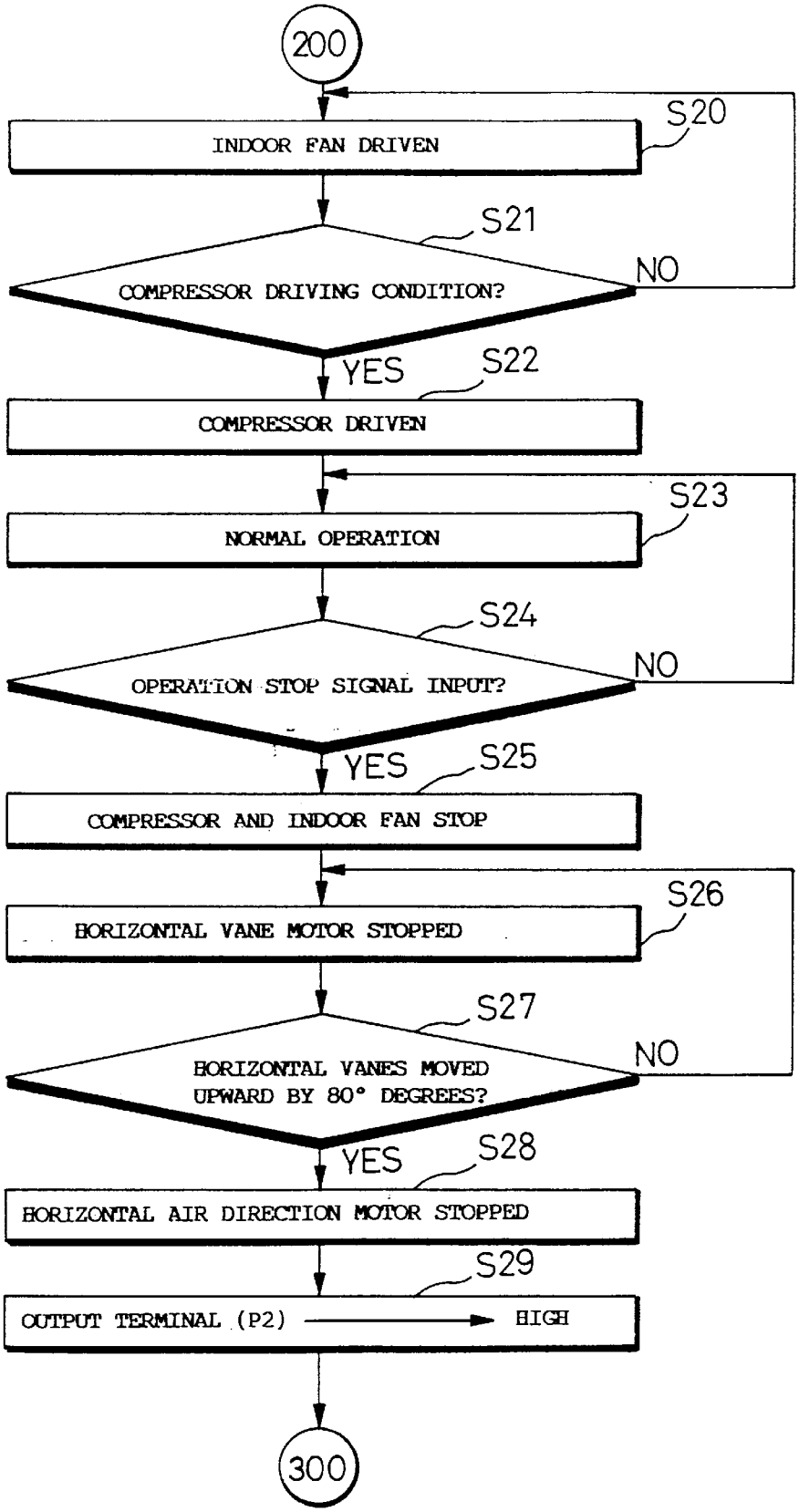
Figure 9D:
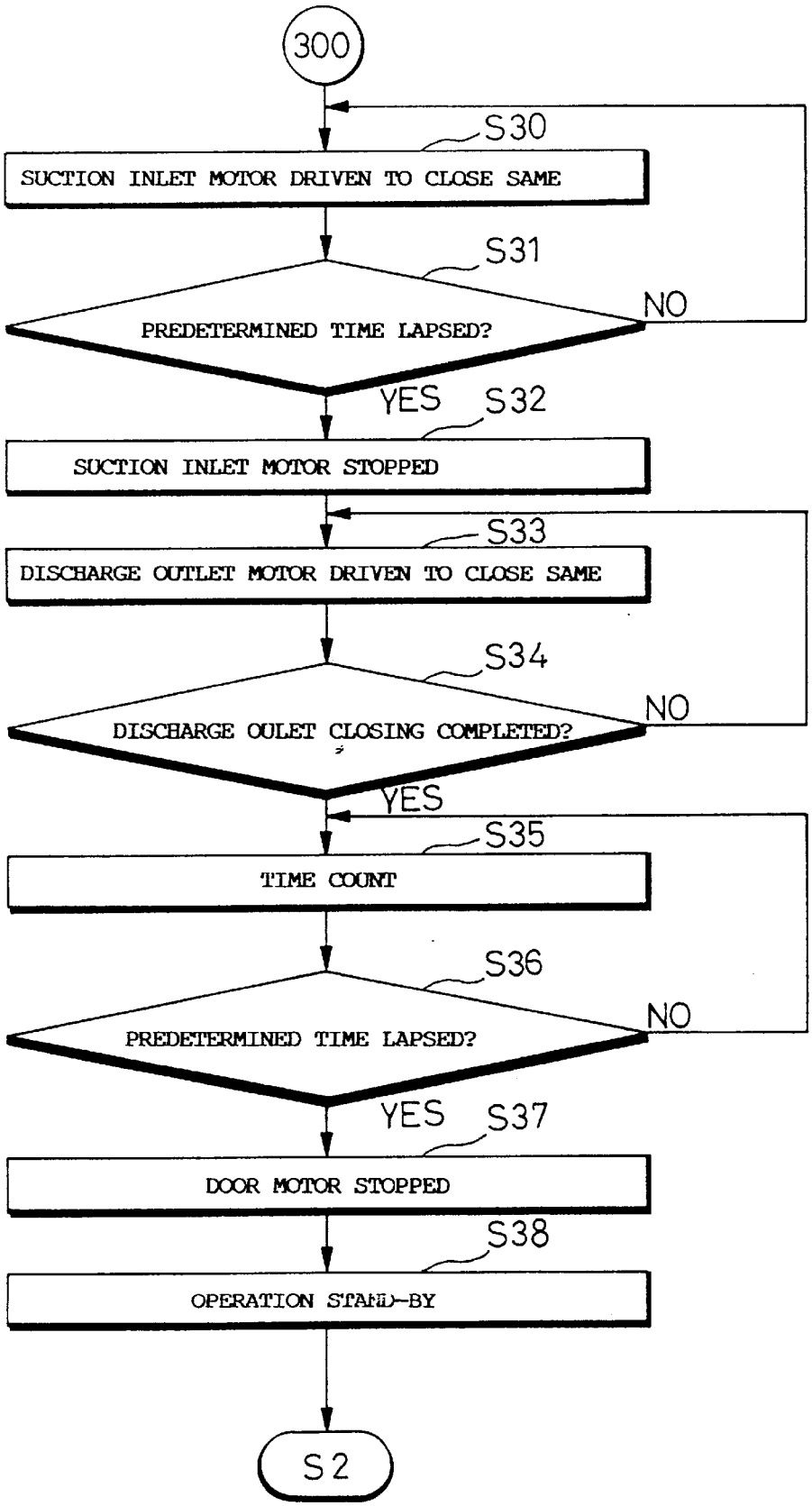

As illustrated in FIGS. 7, 8 and 8A, power means 100 serves to change a commercial AC voltage supplied from an AC power terminal 100 to a predetermined DC voltage necessary for operation of the air conditioner to thereafter output same.

Operation manipulating means 102 contains a plurality of functional keys for selecting operation modes of the air conditioner (automatic, cooling, heating, dehumidifying, blowing and the like), air flow amount (strong wind, weak wind, intermediate wind and the like) discharged through the discharge outlet 7, desired air temperature Ts (hereinafter referred to as established temperature), and an operation/stop key (hereinafter referred to as an operation key) for inputting an operation start signal and an operation stop signal to the air conditioner.

Control means 104 is a microcomputer adapted to receive a DC voltage output from the power means 100 to initialize the air conditioner and to control all operations of the air conditioner according to an operation selecting signal input by the operation manipulating means 102.

The control means 104 serves to control the electric power applied to the suction inlet motor 31 for opening and closing the discharge outlet motor 21 and the suction grille and for effecting an open/close operation of the suction grille 34 by counting a closing drive time of the suction inlet motor 31.

Room temperature detecting means 106 is adapted to monitor a present room temperature Tr so that the temperature can become a temperature Ts established by the user according to the operation manipulating means 102. The discharge outlet open/close driving means 108 receives a control signal emitted from the control means 104 to controllably drive the discharge outlet motor 21 so that the discharge outlet door 13 for opening and closing the discharge outlet 7 can be vertically shifted.

Furthermore, discharge outlet open/close detecting means 110 serves to detect whether the discharge outlet door 13 is opened or closed.

Suction inlet open/close driving means 112 receives a control signal generated from the control means 104 when the operation start signal and the stop signal are input by the operation manipulating means 102 to controllably drive the suction inlet motor 31, wherein the means 112 includes an inverter IC 113 for inverting a high-level open control signal and a high-level close control signal generated from output terminals P1 and P2 of the control means 104, a relay RY I for driving with a DC voltage (12V) output from the power means 100 so that the suction inlet motor 31 can be driven in forward direction when a low-level open control signal inverted by the inverter IC 113 is output, and another relay RY2 for driving with the DC voltage output from the power means 100 so that the suction inlet motor 31 can be driven in reverse direction when a low-level close control signal inverted by the inverter IC 113 is generated.

Suction inlet detecting means 114 serves to detect a position of the slide member 33 to determine whether the vanes 34 have opened the suction inlet 3.

Air direction adjusting means 116 serves to adjust directions of the discharged air horizontally and vertically so that the air can be evenly dispersed to the entire area of the room, where the means 116 includes an adjusting unit 118 for receiving a control signal output from the control unit 104 to drive a motor 119 so that the horizontal vanes 9 can be vertically moved, and an adjusting unit 120 for receiving a control signal generated from the control unit 104 to drive a motor 121 so that the vertical vanes 11 can be horizontally moved.

Compressor driving means 122 receives a control signal output from the control unit 104 according to a difference between the temperature Ts established by the user at the operation manipulating means 102 and a room temperature Tr detected by the room temperature detecting means 106 to thereby controllably drive a compressor 123.

Fan motor driving means 124 receives a control signal emitted from the control unit 104 to control the speed of indoor unit fan motor 39 to drive indoor fan 41 so that the air heat-exchanged by the heat exchanger 37 can be blown indoors.

Furthermore, display means 126 displays operation selection modes (automatic, cooling, dehumidifying, blowing, heating and the like) input by the operation manipulating means 102 according to control of the control means 104, established temperature Ts and room temperature Tr, and displays an operation state of the air conditioner as well.

Now, the operation of the open/close control apparatus will be described.

FIGS. 9A through 9D are flow charts for illustrating open/close control operating procedures of an air conditioner according to the present invention and reference symbol S in the drawings refers to method steps.

It is presumed that the suction inlet 3 and the discharge outlet 7 are closed as an initial condition for describing the operational procedures.

First of all, when a power is applied to the air conditioner, the power source means 100 serves to convert the commercial AC voltage supplied from the AC power terminal 101 to a predetermined DC voltage necessary for driving the air conditioner and thereafter outputs same to respective driving circuits and to control means 104.

At step S1, the DC voltage output from the power source means 100 is received by the control means 104 to thereby initialize the air conditioner.

At this time, when the operation modes (automatic, cooling, dehumidifying, blowing, heating and the like) desired by the user according to the manipulation of the operation manipulating means 102 and the established temperature Ts are input and operation key is pressed, an operation selection signal and an operation start signal (hereinafter referred to as an operation signal) are input to the control means 104 from the operation manipulating means 102.

Successively, at step S2, control means discriminates whether an operation signal is input from the operation manipulating means 102, and if no operation signal is input (in case of NO), repeated operations subsequent to step S2 are performed with the air conditioner being maintained at an operation stand-by state.

As a result of the discrimination at step S2, if the operation signal is input (in case of YES), flow advances to step S3, where the control means 104 outputs a driving pulse to the adjusting unit 118 for swinging the horizontal air direction vanes 9 upward (e.g., by 10 degrees) to a clearance position so that the discharge outlet door 13 can be smoothly opened without being obstructed by the vanes 9.

The adjusting unit 118 receives the driving pulse output from the control means to drive the motor 119, which in turn causes a plurality of link members to cooperatively be operated and to simultaneously swing the horizontal vanes 9 upward.

At step S4, a counter of the control means 104 counts the number of pulses output during the drive of the motor 119 and compares that number with a reference value to determine whether the vanes 9 have moved 10 degrees upward.

As a result of the discrimination at step S4, if the vanes 9 are not swung 10 degrees upward (in case of NO), flow returns to step S3, where the control means 104 generates driving pulses to the adjusting unit 118 until the vanes 9 are moved 10 degrees upward and repeats operations subsequent to step S3.

As a result of the discrimination at step S4, if the vanes have moved 10 degrees upward (in case of YES), flow proceeds to step S5, where the adjusting unit 118 receives the driving pulses output from the control unit 104 to stop the motor 119 and to thereby discontinue the upward moving operation of the vanes 9.

Successively, at step S6, the control means 104 outputs a control signal of high level to the suction inlet open/close driving means 112 via an output terminal P1 in order to open the suction inlet 3 which has been closed.

In that regard, the control signal of high level output from the output terminal PI of the control means 104 is inverted to a low level via the inverter IC 113, and the relay RYI is driven by a DC voltage (12V) output from the power source 100 to thereby close a contact RY1C.

When the contact RY1C of the relay RYI is closed, an AC voltage is applied to a winding 31 a of the suction inlet motor 31 from the AC power source terminal 101, step S7, to thereby drive the suction inlet motor 31 in a forward direction and to rotate the pinion 32 engaged with an axle of the suction inlet motor 31.

The slide member 33 meshed with the pinion 32 is raised, and the slanted slots 33*a* are also raised.

The protruders 34*b* of the vanes 34 are rotated in response to the raising of the slots 33*a* and are guided within the grooves 35*b*.

Each vane 34 is rotated at a predetermined angle about its hinge axle 34*a* to open the suction inlet 3.

At step S8, the control means 104 counts a driving time of the suction inlet motor 31 to determine whether a predetermined period of time (e.g., approximately 1 minute) has lapsed, and if the predetermined period of time has not lapsed (in case of NO), flow returns to step S7 to continuously drive the suction inlet motor 31.

As a result of the discrimination at step S8, if the predetermined period of time has lapsed (in case of YES), flow proceeds to step S9, where the control means 104 generates a control signal to the door motor driving means 108 in order to open the discharge outlet 7 which has been closed.

Successively, the door motor driving means 108 drives the discharge outlet motor 21 according to the control of the control means 104 to thereby drive the discharge outlet motor in the forward direction.

The pinion 23 coupled to the axle 22 of the discharge outlet motor 21 lowers the rack 25 and the discharge outlet door 13 coupled to the rack 25 to open the discharge outlet 7.

A required period of time (e.g., approximately 11.5 seconds) for opening the suction grille 34' is longer by approximately 1 second than the time period (approximately 10.5 seconds) required for opening the discharge outlet door 13, so that, in accordance with the invention, a driving start point of the suction inlet motor 31 where the suction grille 34' starts to open is set to be sooner by 1 second than the start point of the discharge outlet motor 21 where the discharge outlet door 13 starts to open, so as to prevent possible consumer complaints due to a continued travel of the suction grille 34' even after the discharge outlet door 13 is opened. That is, the opening completion moments for the suction grille 34' and the discharge outlet door 13 are made to be the same.

Successively at step S10, the position of the discharge outlet door 13 moved downward by the discharge outlet motor 21 is detected by the door open/close detecting means 110 and a raised position of the slide member 33 moved upward by the suction inlet motor 31 is detected by suction inlet openness detecting means 114.

Now, the control means 104 receives a signal detected by the discharge outlet open/close detecting means 110 and the suction inlet openness detecting means 114 to determine whether the discharge outlet door 13 and the suction grille are opened, and if the door 13 and grille 34' are not opened (in case of NO), flow proceeds to step S10 to continuously drive the discharge outlet motor 21 and the suction inlet motor 31 until the door 13 and the grille 34' are opened.

As a result of the discrimination at step S10, if the door 13 and the grille 34' are opened (in case of YES), flow advances to step S11, where the discharge outlet open/close driving means 108 stops the discharge outlet motor 21 according to control of the control means 104 to terminate the opening operation of the discharge outlet door 13.

Suction inlet open/close driving means 112 stops driving of the suction inlet motor 31 according to the control signal of low level output from the output terminal P1 at the control means 104 to thereby terminate an opening operation of the suction grille 34'.

When the discharge outlet door 13 and the suction grille 34' are completely opened, the control means 104, at step S12, generates to the vertical air direction adjusting unit 114 a driving pulse for swinging the horizontal vanes 9 downward so that an operational original point for performing an accurate position control of the horizontal vanes 9 can be fixed.

Successively, the adjusting unit 114 receives a driving pulse output from the control means 104 to drive the motor 115, such that the plurality of link members 29 are cooperatively activated to simultaneously move the horizontal vanes 9 downwards.

At step S13, the control means counts the number of pulses which are output during the drive of the motor 115 to thereby determine whether the horizontal vanes 9 have reached an original starting position thereof.

As a result of the discrimination at step S13, if the horizontal vanes 9 have not reached the original starting position thereof (in case of NO), flow returns to step S12, where the control means 104 outputs driving pulses to the adjusting unit 114 until the vanes 9 reach the original starting position thereof, and repeats operations subsequent to step S12.

Meanwhile, as a result of the discrimination at step S13, if the vanes 9 have reached the original starting point thereof (in case of YES), flow proceeds to step S14, where the control means 104 generates a driving pulse to the adjusting unit 114 for moving the vanes 9 upward so that the vanes 9 can be positioned at a vertically central position, i.e. horizontally disposed, facing the front side of the air conditioner.

That is, the adjusting unit 114 receives the driving pulse from the control unit 104 to drive the motor 115 such that the plurality of link members 29 are cooperatively activated to upward swing the plurality of horizontal vanes 9 simultaneously.

At this time, at step S15, the control means 104 counts the number of pulses output when the horizontal air direction motor 115 is driven, thereby determining whether the vanes 9 have reached the center, horizontal position.

As a result of the discrimination at step S15, if the vanes 9 are not positioned in the center (in case of NO), flow returns to step S14, where the control means 104 outputs a driving pulse to the adjusting unit 114 until the vanes 9 reach the center position.

Meanwhile, as a result of the discrimination at step S15, if the vanes 9 have reached the center position (in case of YES), flow proceeds to step S16, where the adjusting unit 114 receives the driving pulse generated from the control means 104 to stop the motor 115, thereby terminating the position control operation of the horizontal vanes 9.

Successively, at step S17, the control means 104 emits a driving pulse to the horizontal air direction adjusting unit 120 to move the vertical vanes 11 to a center position.

The adjusting unit 120 receives the driving pulse emitted from the control means 104 to drive the motor 121 so that the plurality of vanes 11 are simultaneously moved to the center, i.e., the vanes are disposed in planes lying perpendicular to a plane of the air outlet.

At step S18, the control means 104 counts the number of pulses emitted from the motor 121 when it is activated and determines whether the vertical vanes 11 are disposed at the center.

As a result of the discrimination at step S18, if the vanes 11 are not positioned in the center (in case of NO), flow returns to step S17, where the control means 104 generates a driving pulse to the adjusting unit 120 until the vanes 11 are positioned in the center and repeats operations subsequent to step S17.

Meanwhile, as a result of the discrimination at step S18, if the vanes 11 are positioned in the center (in case of YES), flow advances to step S19, where the adjusting unit 120 receives the driving pulse emitted from the control means 104 to stop the motor 121 to finish a position control operation of the vanes 11. Thus, the vanes 9, 11 are now oriented to discharge the air in a forward direction perpendicular to a plane of the outlet.

Successively, at step S20, fan motor driving means 124 controls the speed of the indoor fan motor 39 according to control of the control means 104 to drive the indoor fan 41.

When the indoor fan 41 is driven, the room air starts to be sucked into the body 1 through the suction inlet 3, at which time, the temperature Tr of the room air sucked through the suction inlet 3 is detected by the room temperature detecting means 106.

At step S21, a comparison is made between the room temperature Tr detected by the room temperature detecting means 106 and the temperature Ts established by the user via the operation manipulating means 102, to thereby determine whether the compressor 123 should be driven.

A driving condition of the compressor 123 means that, in case of a cooling operation, the room temperature Tr detected by the room temperature detecting means 106 is larger than the temperature Ts established by the user, and, in case of a heating operation, the room temperature Tr detected by the room temperature detecting means 106 is smaller than the temperature Ts established by the user.

As a result of the discrimination at step S21, if the compressor 123 is not required to be driven (in case of NO), flow returns to step S20, whereby the room temperature Tr is continually detected, and operations subsequent to step S20 are repeated. If the compressor 123 is required to be driven (in case of YES), flow advances to step S22, where the control means 104 determines an operation frequency of the compressor 123 as a function of the difference between the room temperature Tr and the established temperature Ts and emits to compressor driving means 122 a control signal for driving the compressor 123.

The compressor driving means 122 then drives the compressor 123 at the operation frequency determined by the control means 104.

When the compressor 123 is driven, the indoor fan 41 is driven at step S23, and the room air is sucked into the body 1 through the suction inlet 3, and the room air sucked through the suction inlet 3 is heated or cooled by the heat exchanger 37.

Upon leaving the heat exchanger 37, the air is moved upward and discharged into the room in a direction determined by the direction angles of the horizontal vanes 9 and vertical vanes 11.

In a normal operation of an air conditioner thus described, a discrimination is made at step S24 as to whether an operation stop signal has been input via an operation key at the operation manipulating means 102, and if the operation stop signal has not been input (in case of NO), flow returns to step S23, and the normal operation continues and operations subsequent to step S23 are repeated.

As a result of the discrimination at step S24, if the operation stop signal has been input during the normal operation (in case of YES), flow proceeds to step S25, where the control signal 104 generates a control signal to the compressor driving means 122 and to fan motor driving means 124 in order to stop the compressor 123 and the indoor fan motor 39.

Successively, the compressor driving means 122 stops the compressor 123 according to the control of the control means 104 and the fan motor driving means 124 stops the indoor fan motor 39 according to the control of the control means 104 to thereby stop driving the indoor fan 41.

At step S26, the control means 104 generates a driving pulse to the adjusting unit 118 in order to move upward the horizontal vanes 9 so that a closing operation of the discharge outlet door 13 can be performed smoothly.

Successively, the adjusting unit 118 receives the driving pulse output from the control means 104 to drive the motor 119, such that the plurality of link members 29 are cooperatively activated to simultaneously swing the plurality of horizontal vanes 9 upward, e.g., by 80 degrees, to a clearance position facilitating closing of the door 13.

At this time, at step S27, the control means 104 counts the number of pulses output from when the motor 119 begins to be driven, so that a discrimination can be made as to whether the vanes 9 have moved 80 degrees upward. If the vanes 9 have not moved 80 degrees upward (in case of NO), flow returns to step S26, where the control means 104 supplies a driving pulse to the adjusting unit 118 until the vanes 9 are moved 80 degrees upward and repeats operations subsequent to step S26.

As a result of the discrimination at step S27, if the vanes 9 have been moved 80 degrees upward (in case of YES), flow proceeds to step S28, where the adjusting unit 118 receives the driving pulse output from the control means 104 to stop the motor 119, thereby terminating the vertical movement operation of the vanes 9.

Successively, at step S29, the control means 104 generates a control signal of high level to the suction inlet open/close driving means via the output terminal P2 in order to close the opened suction inlet 3.

Then, the high level control signal output from the output terminal P2 at the control means 104 is inverted to a low level via the inverter IC 113, and the relay RY2 is driven by DC voltage 12V output from the power source means 100 to thereby close a contact RY2C at the relay RY2.

When the contact RY2C of the relay RY2 is closed, an AC voltage is applied to a winding 31*b* of the suction inlet motor 31 from the AC power source terminal 101, step S30, to thereby drive the suction inlet motor 31 in the reverse direction, which then reverses the rotation of the pinion 32 coupled to the axle of the suction inlet motor 31.

The slide member 33 meshed with the pinion 32 is lowered to thereby lower the slide member 33 and the slots 33*a* thereof.

In response to a descent of the slots 33*a*, the protruders 34*b* are rotated about the axes of axles 34*a* while being guided by the grooves 35*b*. Thus, the vanes 34 of the suction grille 34 are rotated by a predetermined angle to close the suction inlet 3.

At step S31, the control means 104 counts a driving time of the suction inlet motor 31 and discriminates if a predetermined time (approximately 11.5 seconds which is a time data needed for closing the suction grille, obtained through tests.) has lapsed, and if the predetermined time has not lapsed (in case of NO), flow returns to step S30, and the suction inlet motor 31 continues to be driven until the suction grille 34 is closed.

As a result of the discrimination at step S31, if the predetermined time has lapsed (in case of YES), flow proceeds to step S32, presuming that the suction grille 34 has been completely closed, where the suction inlet open/close driving means 110 stops the motor 31 according to a control signal of low level output from the output terminal P2 at the control means 104, thereby terminating the closing operation of the suction grille 34.

Successively, at step S33, the control means 104 generates a control signal to the discharge outlet open/close driving means 108 in order to close the discharge outlet which has been opened.

The discharge outlet open/close driving means 108 activates the discharge outlet motor 21 according to the control of the control means 104 to thereby drive the discharge outlet motor 21 in the reverse direction, where the pinion 23 coupled to the axle 22 of the discharge outlet motor 21 is driven to move the rack 25 upward, and the discharge outlet door 13 coupled to the rack 25 is moved upward to close the discharge outlet 7.

At this time, at step S34, the position of the raised discharge outlet 13 is detected by the detecting means 110, so the control means 104 receives a signal detected by the detecting means 110 to discriminate whether the discharge outlet 13 is closed.

As a result of the discrimination at step S34, if the discharge outlet 13 is not closed (in case of NO), flow returns to step S33, to keep driving the discharge outlet motor 21 until the discharge outlet 13 is completely closed.

In case of the discharge outlet door 13 having been closed (in case of YES), flow advances to step S35, where the control means 104 counts the time of the discharge outlet door 13 being closed.

It should be noted that, because the position of the sensor for detecting the closing operation of the discharge outlet door 13 is below a position where the discharge outlet door 13 is completely closed (i.e., the sensor is at a position whereby it is actuated approximately one second prior to a complete door closing), the discharge outlet motor 21 must be driven to move the discharge outlet door 13 upward to a fully closed state, even after the sensor detects the door. Therefore, the driving time of the discharge outlet motor 21 must be counted from the actuation of the sensor.

As a result of the discrimination at step S36, if the predetermined time has not lapsed (in case of NO), flow returns to step S35, and repeats operations subsequent thereto.

If, as a result of the discrimination at S36, the predetermined time has lapsed (in case of YES), it is presumed that the discharge outlet door 13 has moved upward to completely close the discharge outlet 7, even if there is a mechanical deformation at an upper end of the discharge outlet 7, so that, flow proceeds to step S37, where the discharge outlet open/close driving means 108 stops the motor 104 to terminate the closing operation of the discharge outlet door 13.

Meanwhile, it should be noted that the driving of the suction inlet motor 31 in steps S30 to S32, occurs simultaneously with the driving of the discharge outlet motor 21 in steps S33 to S37; the steps 30–37 are listed in sequence in the drawing merely to simplify the explanation.

Successively, at step S38, the control means 104 maintains the air conditioner at a stand-by state until an operation signal is input again by the operation manipulating means 102, and returns to step S2 to repeat operations subsequent to step S2.

As is apparent from the foregoing, advantages result from the open/close control apparatus of an air conditioner and method thereof according to the invention, such as: (a) the closures for the suction inlet 3 and the discharge outlet 7 reach their fully opened states simultaneously; (b) the vanes 9 are swung upwardly before the door 13 is swung upwardly or downwardly, to thereby enable the open/close operations of the discharge outlet door 13 to function smoothly, (c) the detection of the position of the discharge outlet door 13 during a closing operation occurs before the door reaches a fully closed state and is driven for a period thereafter, to enable an accurate closing of the discharge outlet door 13 even when there is a mechanical discrepancy at an upper area of the discharge outlet 7, and (d) the vanes 9 and 11 are oriented in respective center positions when the discharge outlet 7 is completely opened, to thereby control the air directions of the discharged air effectively.

Although the present invention hag been described in connection with a preferred embodiment thereof, it will be appreciated by those skilled in the art that additions, deletions, modifications, and substitutions not specifically described may be made without departing from the spirit and scope of the invention as defamed in the appended claims.

What is claimed is:

1. A method of operating a room air conditioner which includes a housing forming an air inlet for receiving incoming room air, and an air outlet for discharging the air back into the room, a plurality of vanes extending across the outlet and being mounted for swinging movement to adjust a flow direction of discharged air, a motor-actuated vane drive arrangement for swinging the outlet vanes, a heat exchanger disposed between the air inlet and air outlet for changing the temperature of air passing therethrough, an air circulator for circulating air into the inlet, through the heat exchanger and out through the outlet, an inlet closure for closing the inlet, an outlet closure for closing the outlet, a motor-driven first mechanism for moving the inlet closure between open and closed states, a motor-driven second mechanism for moving the outlet closure between open and closed states, and an input means for inputting operating instructions including operation start and stop instructions, the method comprising the steps of:

A) actuating the vane drive arrangement for moving the outlet vanes to a clearance position facilitating an opening of the outlet closure in response to an operation start instruction being input to the input means; thereafter B) actuating the first and second mechanisms for opening the inlet and outlet closures, respectively; thereafter C) swinging the vanes to a position for discharging air in a generally forward horizontal direction; and thereafter D) actuating the circulator and heat exchanger for performing an air conditioning operation.

2. The method according to claim 1, further comprising, subsequent to step D, the steps of:

E) actuating the vane drive arrangement for moving the vanes to a clearance position facilitating closing of the outlet closure, in response to an operations stop instruction being input to the input means; and thereafter F) actuating the first and second mechanisms for closing the inlet and outlet closures, respectively.

3. The method according to claim 2 further including the step of detecting a position of the outlet closure during step F and continuing to perform step F for a predetermined time period following the detection step.

4. The method according to claim 1 wherein the inlet closure comprises a grille formed by swingable inlet vanes, a time period for fully opening the inlet closure being greater than a time period for fully opening the outlet closure, and step B comprises initiating actuation of the first mechanism prior to initiating actuation of the second mechanism to cause the inlet and outlet closures to reach their respective open states simultaneously.

5. The method according to claim 1 wherein step A comprises swinging the vanes upwardly by an angle greater than zero degrees and not greater than 30 degrees.

6. The method according to claim 1 wherein step E comprises swinging the vanes upwardly by an angle from 60 to 90 degrees.

7. A method of operating a room air conditioner which includes a housing forming an air inlet for receiving incoming room air, and an air outlet for discharging the air back into the room, a plurality of outlet vanes extending across the outlet and being mounted for swinging movement to be adjustable for varying a direction of flow of discharged air, a motor-actuated outlet vane drive mechanism for swinging the outlet vanes, a heat exchanger disposed between the air inlet and air outlet for changing the temperature of air passing therethrough, an air circulator for circulating air into the inlet, through the heat exchanger and out through the outlet, an inlet closure in the form of swingable inlet vanes for closing the inlet, an outlet closure for closing the outlet, a motor-driven first mechanism for moving the inlet closure between open and closed states, a motor-driven second mechanism for moving the outlet closure between open and closed states, a detector for sensing a position of the outlet closure, an input means for inputting operating instructions including operation start and stop instructions, and a controller connected to the input means and the first and second mechanisms for controlling operation of the first and second mechanisms, the method comprising the steps of:

A) actuating the vane drive arrangement for swinging the outlet vanes to a clearance position away from a path of travel of the outlet closure, in response to an operation start instruction being input to the input means; thereafter B) actuating the first and second mechanisms for moving the inlet and outlet closures to their respective open states;

C) receiving a signal from the detector during step B for indicating a position of the outlet closure;

D) swinging the outlet vanes from the clearance position to an air discharge position for directing air during operation of the air conditioner;

E) actuating the vane drive arrangement for moving the outlet vanes to a clearance position away from a path of travel of the outlet closure, in response to an operation start instruction being input to the input means; thereafter F) actuating the first and second mechanisms for moving the inlet and outlet closures to their respective closed states; and G) receiving a signal from the detector during step F for detecting a position of the outlet closure.

8. The method according to claim 7, wherein the respective time periods for fully opening the inlet and outlet closures are different, and further comprising the step of synchronizing operations of the first and second mechanisms for causing the inlet and outlet closures to reach their respective closed states simultaneously.

9. The method according to claim 7 wherein the controller counts pulses during steps A and E for determining whether the outlet vanes have reached a final position away from the path of travel of the outlet closure.

10. The method according to claim 7 wherein step F comprises actuating the second mechanism for a predetermined time period following step G to ensure that the outlet closure reaches its closed state.

11. The method according to claim 10 wherein the predetermined time period is 1 to 3 seconds.

12. The method according to claim 7 wherein step A comprises swinging the outlet vanes upwardly to a predetermined orientation, and step B comprises moving the outlet closure downwardly.

13. The method according to claim 12 wherein step A comprises swinging the outlet vanes upwardly by an angle greater than zero and not greater than ninety degrees.

14. The method according to claim 12 wherein step A comprises swinging the outlet vanes upwardly by an angle greater than zero and not greater than thirty degrees.

15. The method according to claim 7 wherein step E comprises swinging the outlet vanes upwardly to a predetermined orientation, and step F comprises moving the outlet closure upwardly.

16. The method according to claim 15 wherein step E comprises swinging the outlet vanes upwardly by an angle in range of 60–90 degrees.

17. The method according to claim 7 wherein each of steps B and F comprises causing the inlet and outlet closures to reach their open and closed states simultaneously.

18. The method according to claim 17 wherein each of claims B and F comprises initiating actuation of one of the first and second mechanisms a predetermined time period prior to initiating actuation of the other of the first and second mechanisms to achieve the simultaneous reaching of the open and closed states.

19. The method according to claim 18 wherein actuation of the first mechanism is initiated prior to actuation of the second mechanism.

20. The method according to claim 19 wherein the predetermined time period is approximately 1 to 3 seconds.

21. The method according to claim 7 wherein step D comprises moving the outlet vanes to a position for discharging air in a forward direction perpendicular to a plane of the outlet.

22. A room air conditioner comprising a housing forming an air inlet for receiving incoming room air, and an air outlet for discharging the air back into the room, a plurality of outlet vanes extending across the outlet and being mounted for swinging movement to be adjustable for varying a direction of flow of discharged air, a motor-actuated outlet vane drive mechanism for swinging the outlet vanes, a heat exchanger disposed between the air inlet and air outlet for changing the temperature of air passing therethrough, an air circulator for circulating air into the inlet, through the heat exchanger and out through the outlet, an inlet closure in the form of swingable inlet vanes for closing the inlet, an outlet closure for closing the outlet, a motor-driven first mechanism for moving the inlet closure between open and closed states, a motor-driven second mechanism for moving the outlet closure between open and closed states, a sensor arranged for sensing a position of the outlet closure prior to that closure reaching a closed state, and a controller connected to the second mechanism and the sensor for actuating the second mechanism for a predetermined period after the sensing of the outlet closure during and outlet closure closing operation.

* * * * *